US012606411B2

(12) United States Patent
Lasswell et al.

(10) Patent No.: US 12,606,411 B2
(45) **Date of Patent: *Apr. 21, 2026**

(54) AUTOMATIC CUT AND TRANSFER COILER AND OR SPOOLER

(71) Applicant: Reel Power Licensing Corp., Oklahoma City, OK (US)

(72) Inventors: David Lasswell, Yukon, OK (US); Christopher David Rekieta, Houston, TX (US); Gary Donald Thompson, Broken Arrow, OK (US); Joseph Henry, Oklahoma City, OK (US)

(73) Assignee: Reel Power Licensing Corp., Oklahoma City, OK (US)

( * ) Notice: Subject to any disclaimer, the term of this patent is extended or adjusted under 35 U.S.C. 154(b) by 163 days.

This patent is subject to a terminal disclaimer.

(21) Appl. No.: 18/428,724

(22) Filed: Jan. 31, 2024

(65) Prior Publication Data

US 2024/0166467 A1 May 23, 2024

Related U.S. Application Data

(63) Continuation of application No. 18/075,644, filed on Dec. 6, 2022, now Pat. No. 11,919,739, which is a (Continued)

(51) Int. Cl.
*B65H 67/00* (2006.01)
*B65H 54/71* (2006.01)
(Continued)

(52) U.S. Cl.
CPC ..... *B65H 67/048* (2013.01); *B65H 54/71* (2013.01); *B65H 54/74* (2013.01); *B65H 2402/352* (2013.01); *B65H 2555/24* (2013.01)

(58) Field of Classification Search
CPC ..... B65H 67/048; B65H 54/71; B65H 54/74; B65H 2555/24; B65H 2402/352
See application file for complete search history.

(56) References Cited

U.S. PATENT DOCUMENTS 4,033,519 A 7/1977 Abe et al.
4,145,010 A 3/1979 Turk et al.
(Continued)

FOREIGN PATENT DOCUMENTS

CN 1220642 A 6/1999
CN 102009874 A 4/2011
(Continued)

OTHER PUBLICATIONS

Rexroth Bosch Group, "MAC Motors", http://www.indramat-US.com/motors/mac-motors/?gclid=EAlalQobChMI1PrFttj14QIVkVuGCh1b2QVAEAAYASAAEgLBW_D_BWE Date Accessed: Apr. 29, 2019.
(Continued)

*Primary Examiner* — Emmanuel M Marcelo
(74) *Attorney, Agent, or Firm* — Phillips Murrah PC; Martin G. Ozinga

(57) ABSTRACT

An automatic cut and transfer coiler and spooler apparatus, system, and method for use generally comprising a rotatable turret with two independently driven spindles thereon wherein the drives for the independent spindles are attached to the turret for selectively rotating the spindles about their own axis independently.

1 Claim, 4 Drawing Sheets

Related U.S. Application Data continuation of application No. 17/240,207, filed on Apr. 26, 2021, now Pat. No. 11,548,753, which is a continuation of application No. 16/670,250, filed on Oct. 31, 2019, now Pat. No. 11,014,774, which is a continuation of application No. 15/432,856, filed on Feb. 14, 2017, now abandoned.

(60) Provisional application No. 62/295,206, filed on Feb. 15, 2016.

(51) Int. Cl.
*B65H 54/74* (2006.01)
*B65H 67/048* (2006.01)

(56) References Cited

U.S. PATENT DOCUMENTS

| | | | | |
|---|---|---|---|---|
| 4,708,298 | A | 11/1987 | Allard et al. | |
| 4,951,889 | A | 8/1990 | Camardella et al. | |
| 5,012,985 | A * | 5/1991 | Pepe | B65H 67/048 242/474.5 |
| 5,156,347 | A | 10/1992 | Gay et al. | |
| 6,015,113 | A | 1/2000 | Daly et al. | |
| 6,045,084 | A | 4/2000 | Binner et al. | |
| 6,062,505 | A | 5/2000 | Bartkowiak | |
| 6,105,896 | A | 8/2000 | Westrich | |
| 6,286,778 | B1 | 9/2001 | Kudrus | |
| 11,014,774 | B2 | 5/2021 | Laswell et al. | |
| 11,548,753 | B2 | 1/2023 | Laswell et al. | |
| 2009/0049669 | A1 | 2/2009 | Lennemann et al. | |
| 2009/0294568 | A1 * | 12/2009 | Baugher | B65H 67/056 242/474.5 |
| 2018/0273339 | A1 * | 9/2018 | Kotzur | B65H 75/246 |
| 2019/0193983 | A1 * | 6/2019 | Henry | B65H 59/385 |

FOREIGN PATENT DOCUMENTS

| | | | | |
|---|---|---|---|---|
| CN | 103717519 | A | 4/2014 | |
| DE | 19827941 | A1 | 1/1999 | |
| DE | 10224033 | A1 | 12/2003 | |
| DE | 102006018820 | A1 | 10/2007 | |
| DE | 102012107015 | A1 | 2/2013 | |
| DE | 10201201849 | A1 | 4/2013 | |
| DE | 102011115051 | A1 | 4/2013 | |
| DE | 102011116156 | A1 | 4/2013 | |
| DE | 102012018491 | A1 | 4/2013 | |
| EP | 0602554 | A1 | 6/1994 | |
| JP | 2007168945 | A | 7/2007 | |
| JP | 2013-35686 | A | 2/2013 | |
| WO | WO2004071922 | A1 | 8/2004 | |
| WO | 2013167450 | A1 | 11/2013 | |
| WO | WO-2020249768 | A1 * | 12/2020 | B65H 67/064 |

OTHER PUBLICATIONS

Rexroth Bosch Group, "2AD Motors", http://www.indramat-US.com/motors/2ad-motors/ Date Accessed Apr. 29, 2019.

* cited by examiner

AUTOMATIC CUT AND TRANSFER COILER AND OR SPOOLER

CROSS-REFERENCE TO RELATED APPLICATIONS

The present application is a continuation of U.S. patent application Ser. No. 18/075,644, filed on Dec. 6, 2022, currently pending, which is a continuation of U.S. patent application Ser. No. 17/240,207, filed on Apr. 26, 2021, now U.S. Pat. No. 11,548,753, issued on Jan. 10, 2023, which is a continuation of U.S. patent application Ser. No. 16/670,250, filed on Oct. 31, 2019, now U.S. Pat. No. 11,014,774, issued on May 25, 2021, which is a continuation of U.S. patent application Ser. No. 15/432,856, filed on Feb. 14, 2017, now abandoned, which claims priority from U.S. Provisional Patent Application Ser. No. 62/295,206, filed on Feb. 15, 2016. Each of the applications listed above is expressly incorporated herein by reference in their entirety.

BACKGROUND OF INVENTION

1. Field of the Invention

In general, the present invention relates to an automatic cut and transfer coiler and spooler. More particularly, the present invention provides a new device, system, and method of using direct drives attached to the rotating turret to independently operate one or more spindles.

2. Description of the Prior Art

It is known in the prior art to provide machines that may take a large quantity of a length of material such as wire, tubing, filaments, cable, and so forth from one generally large source to then divide as desired into smaller units for sale and or distribution on either a spool where a drum is utilized to wrap the lengths and or coil the length of material such that no drum and or spool is utilized.

In the prior art, it is known to use automatic cut and transfer (also known as ACT) coilers and spoolers such that a first spindle is independently rotated to receive the length of material desired and then cut for removal from the machine either in a coil fashion or on a spool. For speed and efficiency, a second spindle also independently rotated may be positioned into place to receive the length of material while the first spindle is cleared from the machine. This allows for continuous use and wrapping of the desired material without the need for stopping.

First spindle and second spindle are typically mounted perpendicularly on a rotatable turret. This allows a first spindle to be loaded with material while the other second spindle is cleared and or removed from the machine. Once a spindle is cleared, the other spindle, now loaded, is moved into position for clearing and or removal while the other spindle is being loaded again. This is accomplished by rotating the turret.

Of note, it is required that each spindle be able to rotate independently and it is known to spin according to the material be loaded. By example, it is known to load 1,000 feet of material in a minute on one spindle while the other spindle is essentially idle for unloading. The turret is typically rotated slower and it is known to rotate at 5 to 10 rotations per minute depending on the material being loaded.

In the prior art, the two spindles are powered independently by two servo motors, respectively, where the servo motors are in a fixed position and typically on a frame that supports the turret and the turret is rotated by a separate motor. The spindles are essentially powered by a belt drive system that allows the spindle motors to stay fixed on the frame and then rotationally power the spindles individually by applying the respective belts. The turret is also driven by a belt. To accomplish the needed rotational movements of the spindles and the turret, the motors must be arranged such that the belts are clear from one another while the spindle motors require a drive transfer pulley cluster. This requires a fairly complicated mechanical power transmission.

Needless to say, belts have a limited service life and need replacing. In the prior art, most of the unit must be disassembled to replace even just one of the three belts regardless if all three need replacing. Placing belts on pulleys also typically requires the adjustment and positioning of the pulley respective of the application and the drive. Still further, belts require tensioning as they become more lax with use. This requires the use of at least two belt tensioners if not three.

The current state of the art automatic cut and transfer coilers and spoolers clearly have room for improvement and attempts at improvements to the associated deficiencies have not provided the desired solutions. Thus, there is a need for an apparatus, process and or system that provides a direct drive for one or more spindles associated with turret type coilers and spoolers. The above discussed limitations in the prior art is not exhaustive. The current invention provides an inexpensive, time saving, more reliable apparatus, method, and system for use with a turret coiler and spooler where the prior art fails.

SUMMARY OF THE INVENTION

In view of the foregoing disadvantages inherent in the known types of automatic cut and transfer coiler and spooler systems now present in the prior art, the present invention provides a new and improved apparatus, system, and method of using. As such, the general purpose of the present invention, which will be described subsequently in greater detail, is to provide a new direct drive automatic cut and transfer coiler and spooler systems, which has all the advantages of the prior art devices and none and or fewer of the disadvantages.

It is, therefore, contemplated that the present invention is an automatic cut and transfer coiler and spooler apparatus, system, and method for use generally comprising a rotatable turret with two independently driven spindles wherein the drives for the independent spindles are attached to the turret and rotate along with the turret, but may independently and selectively rotate around their own respective axis.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved automatic cut and transfer coiler and spooler for use in transferring lengths of material, cables, wires, tubing and so forth from one large source location to other smaller units for sale and or distribution.

Furthermore, an object of the present invention is to provide a new and improved automatic cut and transfer coiler and spooler apparatus, system, and method, which allows for an independent direct drive for each spindle and or turret.

Another object of the present invention is to provide a new and improved automatic cut and transfer coiler and spooler, which does not require a drive transfer pulley system and or will not require a belt drive system for the spindles and or the turret while still providing independent rotation of the individual spindles around their own respective axis and or turret.

It is a further object of the present invention to provide a new and improved automatic cut and transfer coiler and spooler apparatus, system, and method, which is of a durable and reliable construction leading to a more robust unit.

An even further object of the present invention is to provide a new and improved automatic cut and transfer coiler and spooler apparatus, system, and method, which is susceptible to a low cost of installation and labor, which accordingly is then susceptible to low prices of sale to the consuming industry, thereby making such a system economically available to those in the field.

Still another object of the present invention is to provide a new and improved automatic cut and transfer coiler and spooler apparatus, system, and method, which provides all of the advantages of the prior art while simultaneously overcoming some of the disadvantages normally associated therewith.

Yet still another object of the present invention is to provide a new and improved automatic cut and transfer coiler and spooler apparatus, system, and method, which eliminates belt drives.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF INVENTION

Figure 1:
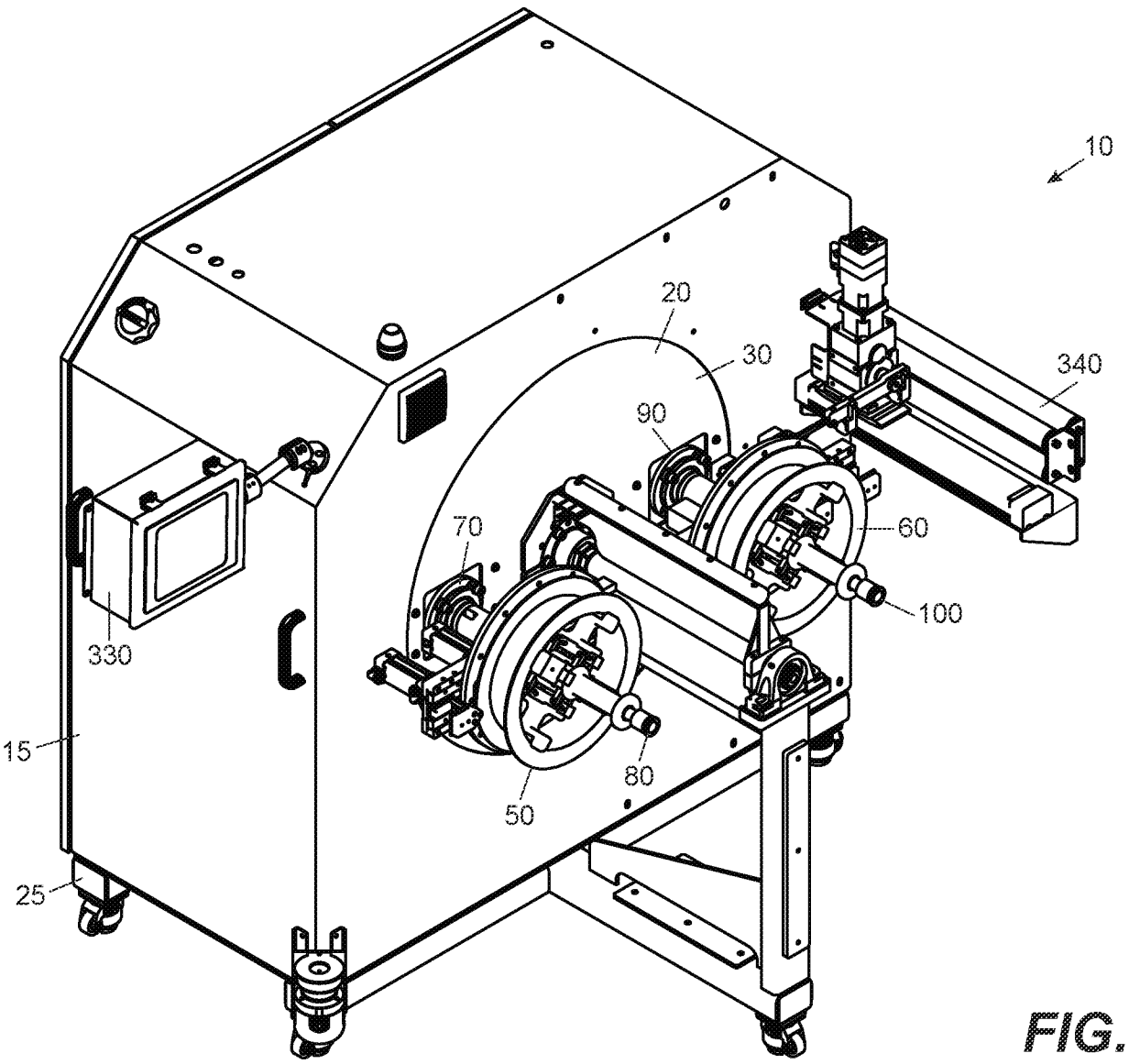
FIG. 1 is a general perspective front view illustration including a housing of a preferred embodiment in accordance with the current invention.

Referring to the illustrations, drawings, and pictures, and to FIG. 1 in particular, reference character 10 generally designates a new and improved automatic cut and transfer coiler and spooler apparatus, system, and method of using same constructed in accordance with the present invention. For purposes of convenience, the reference numeral 10 may generally be utilized for the indication of the invention, portion of the invention, preferred embodiments of the invention and so on. Invention 10 is generally used in coiling and spooling operations, which may or may not include automatic cutting.

Figure 2:
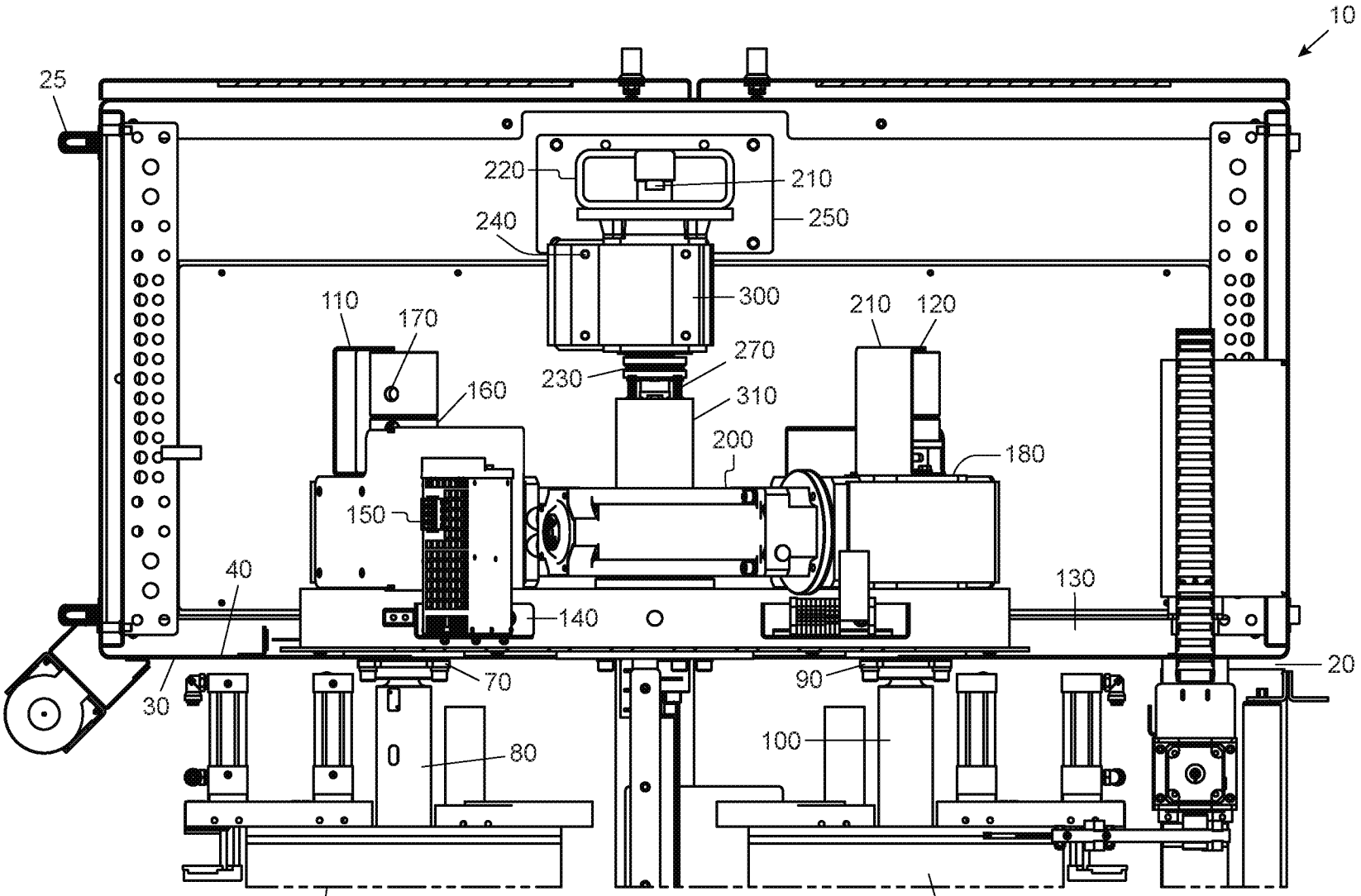
FIG. 2 is a general top cutaway illustration of the same general embodiment in FIG. 1 in accordance with a preferred embodiment of the current invention.
Figure 3:
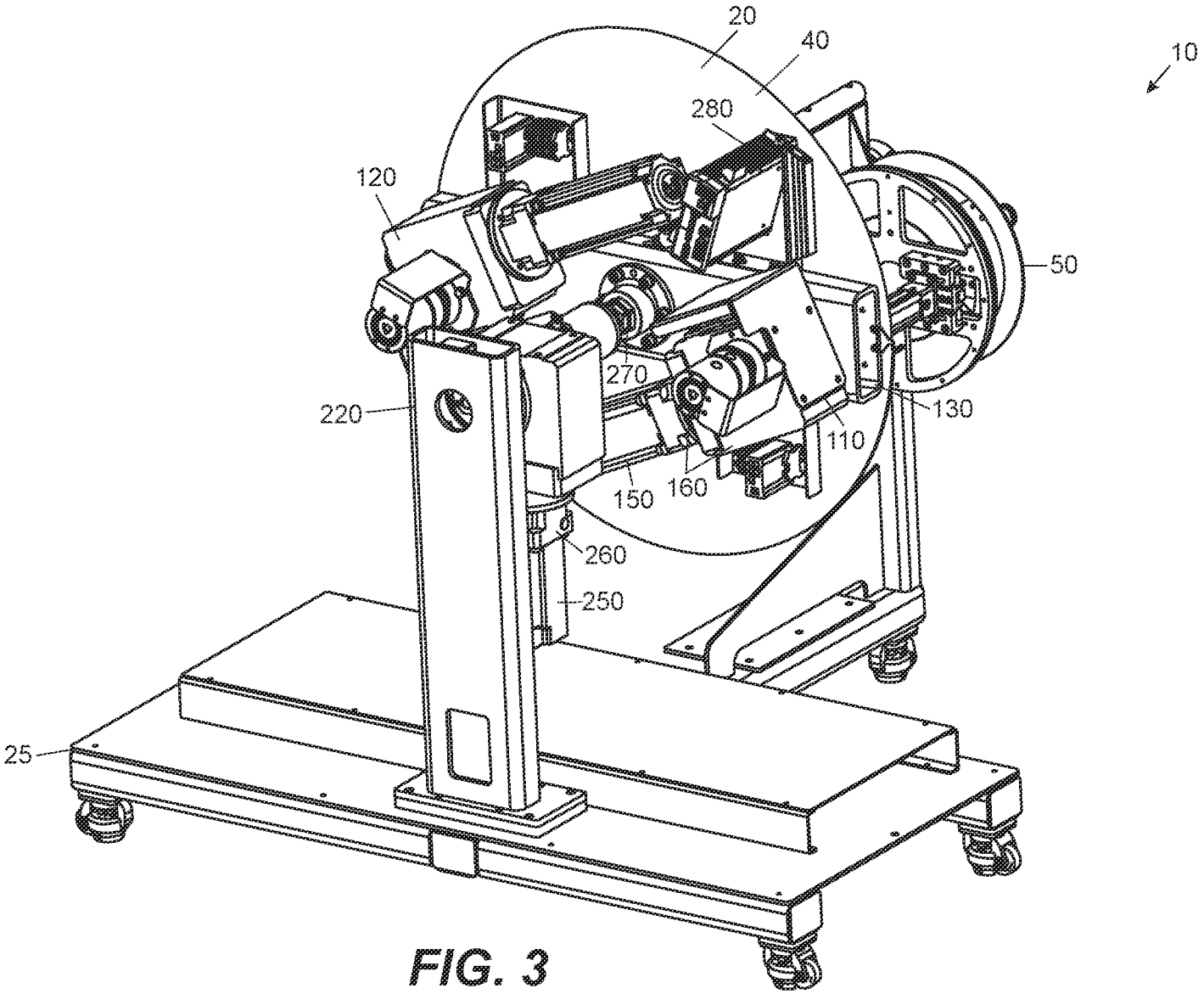
FIG. 3 is a general perspective first back view illustration of the same general embodiment of FIG. 1 without the housing in accordance with a preferred embodiment of the current invention.
Figure 4:
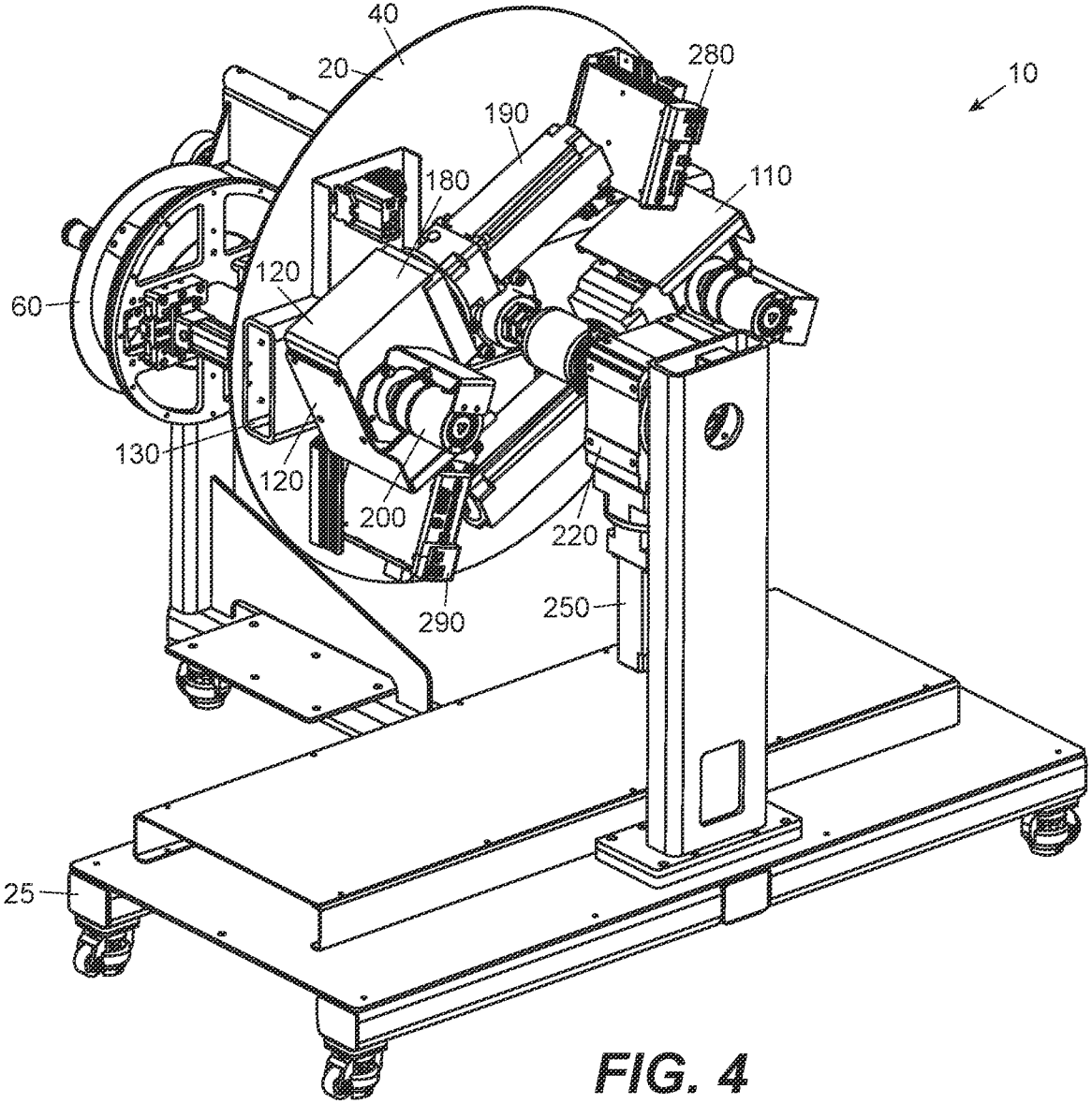
FIG. 4 is a general perspective second back view illustration of the same general embodiment of FIG. 1 without the housing in accordance with a preferred embodiment of the current invention.

Now referring to the figures and more specifically FIGS. 2, 3, and 4, invention 10 may generally include a turret 20 having a first side 30 and a second side 40 wherein first side 30 may have a first spindle 50 and or a second spindle 60. Turret 20 generally has a first aperture 70 for a first drive shaft 80 to communicate from said first side 30 to said second side 40. Turret 20 generally has a second aperture 90 for a second drive shaft 100 to communicate from said first side 30 to said second side 40.

Of note, FIG. 1 generally depicts invention 10 with a cover and or housing 15. FIGS. 2, 3, and 4 generally depict invention 10 without housing 15. It is understood that invention 10 may include a rolling platform 25 although it is also contemplated that other preferred embodiments may not.

First spindle 50 generally rotates via first drive shaft 80 in communication with an electric powered first direct drive system 110 that is attached to turret 20 first side 30 and second spindle 60 rotates via second drive shaft 100 in communication with an electric powered second direct drive system 120 also attached to turret 20 first side 30.

Invention 10 contemplates that first direct drive system 110 and second direct drive system 120 generally rotate on turret 20 as turret 20 rotates as needed wherein the prior art does not. It is contemplated that first direct drive system 110 and second direct drive system 120 are generally attached via bracket system 130 attached to turret 20 second side 40.

First direct drive system 110 generally drives first spindle 50 via first drive shaft 80 wherein first direct drive system 110 rotates first drive shaft 80 via first gear reducer 140, which may be but is not limited to a direct drive hollow shaft gear reducer. First gear reducer 140 is generally attached to first servo drive 150, first servo motor 160, a single passage rotary union 170, and so forth.

Second direct drive system 120 generally drives second spindle 60 via second drive shaft 100 wherein second drive system 120 rotates second drive shaft 100 via second gear reducer 180, which may be but is not limited to a direct drive hollow shaft gear reducer. Second gear reducer 180 is generally attached to second servo drive 190, second servo motor 200, a single passage rotary union 210, and so forth.

Turret 20 electric powered main direct drive system 220 may include a multiple and or single passage rotary union 230, a gear reducer 240, a servo drive 250, a servo motor 260, and so forth. Turret 20 drive system 220 generally attaches to second side 40 of turret 20 via drift shaft 270. Invention 10 generally contemplates that turret 20 and the attached first direct drive system 110 and attached second direct drive system 120 are rotated via turret 20 drive system 220.

First direct drive system 110 may include a first automatic control drive 280, second direct drive system 120 may include a second automatic control drive 290, turret 20 drive system 220 may include a turret automatic control drive 300, and so forth. Invention 10 generally contemplates that turret 20 drive system 220 is in a fixed relationship to turret 20 and may provide power for first direct drive system 110 and attached second direct drive system 120 via slip ring 310. It is understood that although power may be generally from drive system 220, first drive system 110 and second drive system 120 are still independently controlled via master control 330.

Master control 330 may be but is not limited to a computer, computer interface, microprocessor, combinations thereof and so forth for controlling invention 10 as desired and as known in the art. It is contemplated that master control 330 may independently selectively rotate first drive system 110, second drive system 120, turret 20 drive system 220 although electrical power may be provided via any one of the respective systems and or independently.

It is understood that invention 10 generally may be powered electrically as known in the art. It is also understood that invention 10 contemplates providing air and an air source for activating cutting mechanisms 340 as known in the art.

It is therefore contemplated that invention 10 may be an automatic cut and transfer coiler and spooler comprising a turret having a first side, a second side, and said turret is adapted to selectively and independently rotate via a main direct drive system connected to said second side; a first spindle attached to said first side of said turret and adapted to selectively and independently rotate for coiling and spooling via a first independent direct drive system attached to said second side of said turret and in communication with said first spindle; a second spindle attached to said first side of said turret and adapted to selectively and independently rotate for coiling and spooling via a second independent direct drive system attached to said second side of said turret and in communication with said second spindle; and a master control computer in communication with said main direct drive system, said first independent drive system, and said second independent drive system for selectively and independently rotating said turret, said first spindle, and said second spindle respectively.

Changes may be made in the combinations, operations, and arrangements of the various parts and elements described herein without departing from the spirit and scope of the invention. Furthermore, names, titles, headings, and general division of the aforementioned are provided for convenience and therefore, should not be considered limiting.

What is claimed is:

1. An automatic cut and transfer coiler and spooler comprising:

a turret having a front side, a back side, a center axis drive shaft, and said turret is adapted to selectively and independently rotate via a main motor direct drive system connected to said back side at said center axis drive shaft wherein said main motor direct drive system includes a main servo drive connected to a main servo motor that is connected to said center axis drive shaft for rotation;

a first spindle attached to said front side of said turret and adapted to selectively and independently rotate for coiling and spooling via a first independent motor direct drive system attached to said back side of said turret and attached to said first spindle via a first drive shaft wherein said first independent motor direct drive system includes a first servo drive connected to a first servo motor that is connected to said first drive shaft for rotation;

a second spindle attached to said front side of said turret and adapted to selectively and independently rotate for coiling and spooling via a second independent electric motor direct drive system attached to said back side of said turret and attached to said second spindle via a second drive shaft wherein said second independent motor direct drive system includes a second servo drive connected to a second servo motor that is connected to said second drive shaft for rotation; and a master control computer in communication with said main motor direct drive system, said first independent motor drive system, and said second independent motor drive system for selectively and independently rotating said turret, said first spindle, and said second spindle respectively.

* * * * *